United States Patent [19]

Hart

[11] 4,038,942

[45] Aug. 2, 1977

[54] SYSTEM FOR SPRAYING A POWDER CIRCUMFERENTIALLY AROUND A PIPE

[75] Inventor: Robert J. Hart, Tulsa, Okla.

[73] Assignee: Commercial Resins Company, Tulsa, Okla.

[21] Appl. No.: 711,635

[22] Filed: Aug. 4, 1976

[51] Int. Cl.[2] ..... B05B 13/02

[52] U.S. Cl. ..... 118/305

[58] Field of Search ..... 118/305, 307, 108, 207, 118/DIG. 11, 208; 222/193; 114/222; 239/177, 225

[56] References Cited

U.S. PATENT DOCUMENTS

| | | | |
|---|---|---|---|
| 2,175,392 | 10/1939 | Henry | 118/307 X |
| 2,193,971 | 3/1940 | Laurent | 118/307 X |
| 3,847,353 | 11/1974 | Wynne | 118/307 X |

*Primary Examiner*—Louis K. Rimrodt
*Attorney, Agent, or Firm*—William S. Dorman

[57] ABSTRACT

A system for spraying powder circumferentially around a pipe comprising a yoke engagable with the pipe for more than 180° of the pipe. The yoke has a powder dispenser mounted thereon and means are provided for driving the yoke circumferentially about the pipe. The system also includes a powder suspension device and a blower-suction device providing a stream of air under pressure to the powder suspension device for creating an air-powder suspension therein. The powder dispenser has an inner housing and an outer housing both having openings adjacent the surface of the pipe and arcuately shaped to conform with the curvature of the pipe. The outer housing forms a space around the periphery of the inner housing. A first conduit connects the powder suspension device to the inner housing of the powder dispenser to provide a spray or stream of air-powder suspension to the surface of the pipe. Another conduit connects with the outer housing of the powder dispenser and the suction inlet of the blower-suction device to suck excess powder from the weld joint and return it to the system.

5 Claims, 5 Drawing Figures

SYSTEM FOR SPRAYING A POWDER CIRCUMFERENTIALLY AROUND A PIPE

CROSS-REFERENCE TO RELATED APPLICATION

The present invention discloses, inter alia, a yoke which is similar to that disclosed and claimed in co-pending application Ser. No. 448,670 filed Mar. 6, 1974, and entitled "Apparatus for Circumnavigating a Dispenser About a Pipe or the Like".

BACKGROUND OF THE INVENTION

1. Field of the Invention

This invention relates to improvements in systems for spraying a powder circumferentially around a pipe or the like. More particularly, this invention involved a suction return to prevent contamination of the air in the region of the pipe joint and to reduce the loss of powder from the system.

2. Description of the Prior Art

In my prior co-pending application, referred to above, there is described a system for spraying or dispensing a powdered material circumferentially around a pipe. The pipe itself is made up from pipe sections which have been previously coated at the mill except for the ends thereof which are left uncoated so that the sections can be welded together in the field in end-to-end relation. The apparatus of the aforementioned co-pending application, therefore, deposits powder on the weld joints (which have been previously heated) to complete the coating of the pipe. However, it is difficult to meter exactly the quantity of powder to be supplied to each weld joint. Obviously, an insufficient quantity will result in a poor or inadequate coating of the weld joint. In practice, a quantity of powder slightly in excess of that required is supplied to the weld joint. This excess powder can result in a contamination of the air in the area of the pipe joint, and it can also result in a loss of powder from the system.

SUMMARY OF THE INVENTION

In light of the above, it is an object of the present invention to provide a system for spraying powder circumferentially around a pipe joint wherein means are provided for sucking up the excess powder adjacent the weld joint and for returning the excess powder to the system.

Briefly stated, the system of the present invention includes a yoke capable of surrounding the pipe in the area of the weld joint and over a portion of the pipe representing more than 180° of the circumference of the pipe. The system also includes a powder dispenser mounted on the yoke, a powder suspension device, a blower-suction device having a suction inlet and an outlet supplying a stream of air under pressure, and a first conduit connecting the outlet of the blower-suction device to the interior of the powder suspension device for creating an air-powder suspension therein. The powder dispenser has an inner housing and an outer housing forming a space therebetween and both housings having openings positioned adjaent the surface of the pipe. A second conduit connects the interior of the powder suspension device with the inner housing of the powder dispenser to provide a stream of air-powder suspension under pressure which is directed against the surface of the weld joint. A third conduit connects with the outer housing in communication with the space between the housings and also the suction inlet for the blower-suction device for returning excess powder from the pipe back into the system. The present invention also includes a vehicle movable along the pipe and upon which the powder suspension device and the blower-suction device are mounted. The vehicle also includes a frame or rack upon which the yoke can be carried when the latter is disengaged from the pipe. A filtered bleed system is also connected to the blower-suction device to regulate the quantity of air supplied to the powder suspension device.

DETAILED DESCRIPTION OF THE PREFERRED EMBODIMENTS

Figure 1:
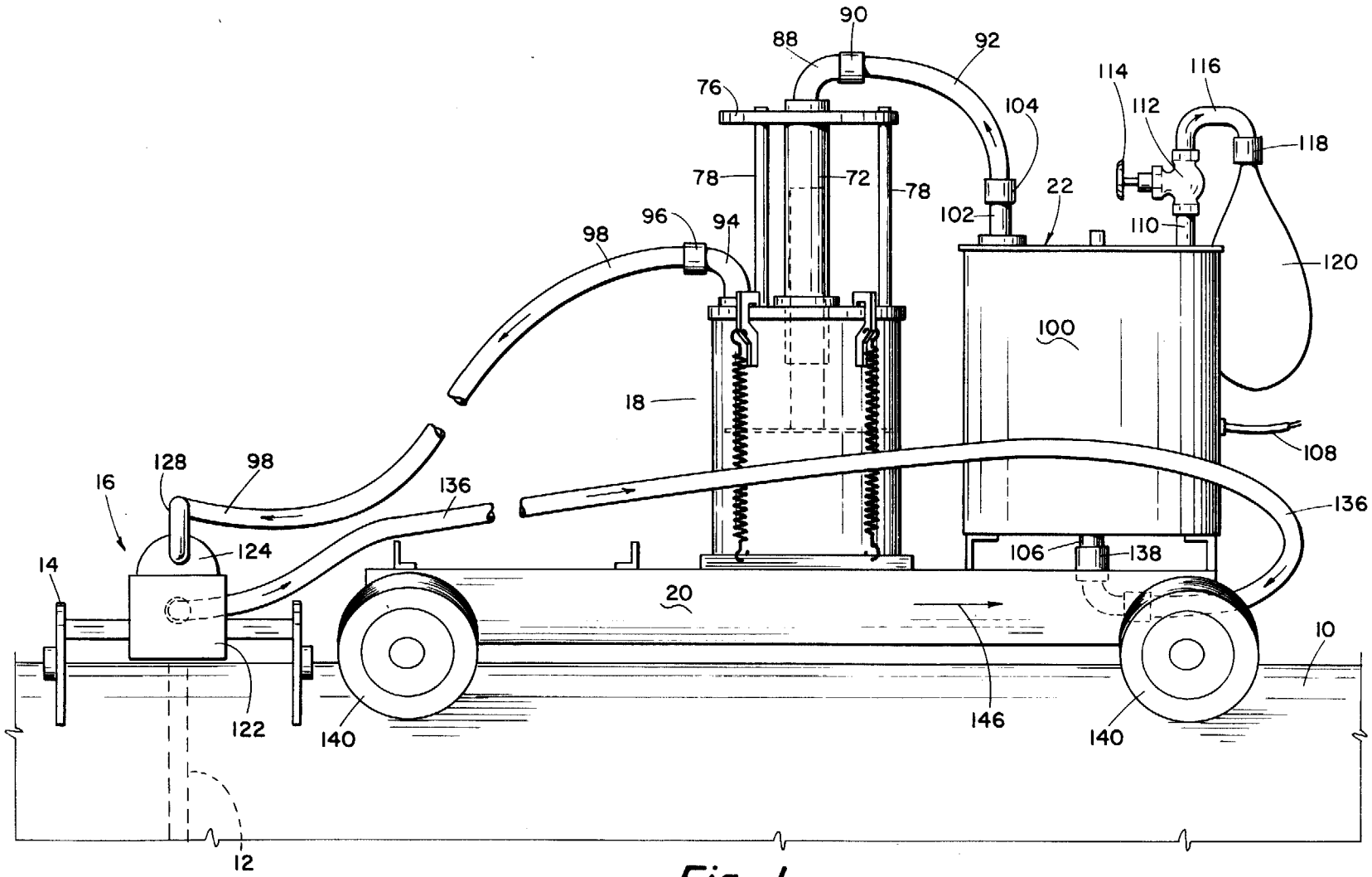
FIG. 1 is a side elevation of the overall apparatus mounted on a pipe, only a portion of the latter being shown.

Referring to the drawings in detail, FIG. 1 shows a pipe 10 which has been made up from pipe sections welded together in end-to-end relation. These pipe sections have been previously coated at the mill except for the ends which, as indicated above, are welded together in the field. The basic purpose of the present invention is to provide an apparatus capable of coating these weld joints, one of which is diagramatically indicated at 12 in FIG. 1. Since the apparatus of the present invention is providing a powder to the surface of the weld joint, the latter would have been previously heated by a suitable heating means (not shown) to a sufficient temperature to cause the powder to melt and cure.

The apparatus of the present invention includes a device or yoke 14 (the details of which will appear more fully hereafter) capable of moving circumferentially about the pipe 10. The yoke 14 has mounted thereon a powder dispenser 16 (the details of which will more fully appear hereafter). A powder suspension device 18 (the details of which will apperar more fully hereafter) is mounted on a vehicle or dolly 20 which is capable of moving along the pipe. The powder suspension device provides a supply of suspended powder to the powder dispenser 16 in a manner later to be described. A blower-suction device 22, which is a vacuum cleaner type blower, provides a source of air under pressure to operate the powder suspension device in a manner later to be described. The blower-suction device 22 also constitutes a means for returning excess powder from the area of the weld 12 in a manner later to be described.

Figure 2:
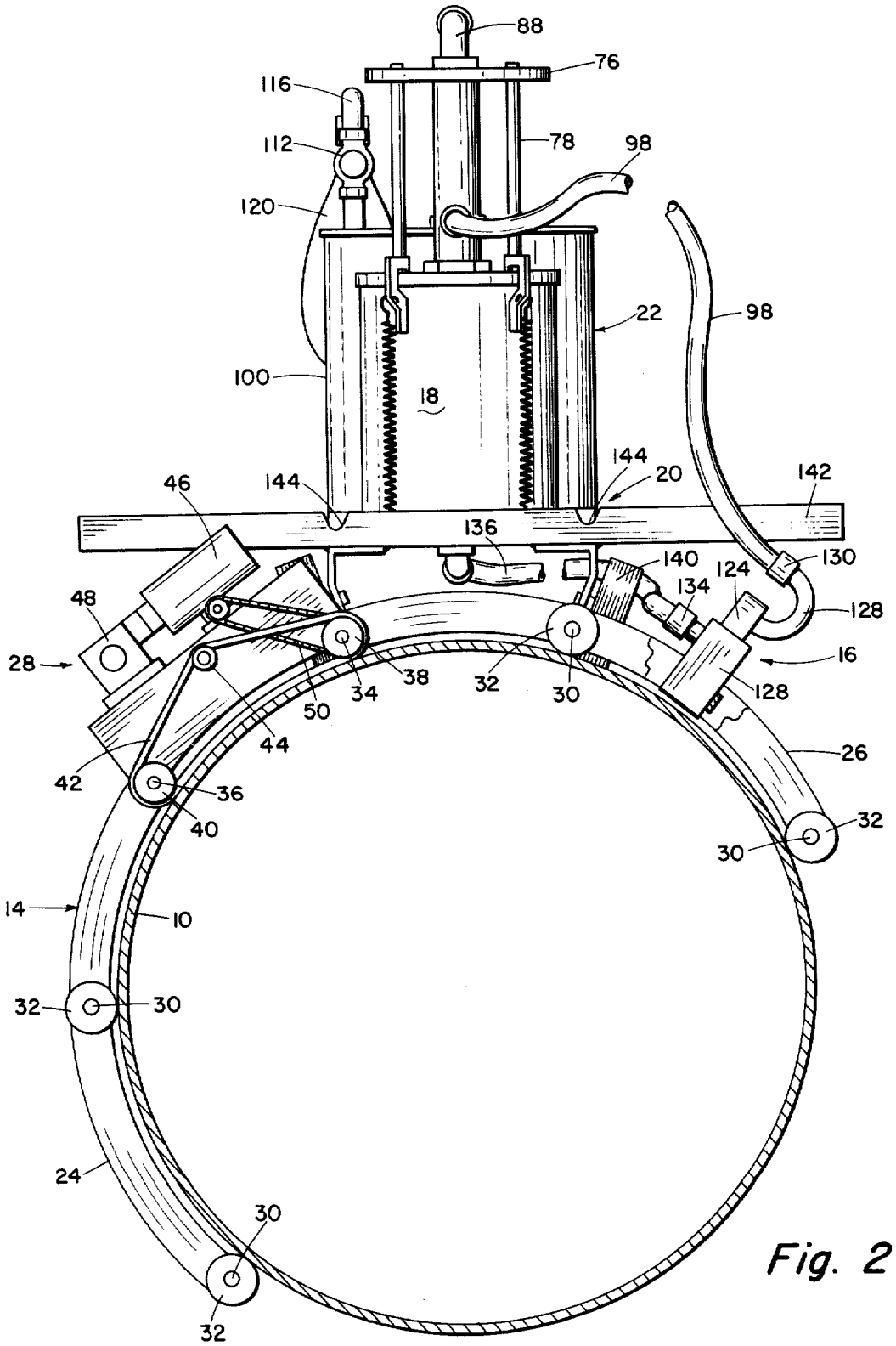
FIG. 2 is a view taken at right angles to FIG. 1, with the pipe being shown in cross section.

Referring also now to FIG. 2, the yoke 14 for circling the pipe is similar to the apparatus disclosed in my co-pending application Ser. No. 448,670 filed on Mar. 6, 1974, and entitled "Apparatus for Circumnavigating a Dispenser About a Pipe or the Like", and includes an arcuate frame 24 formed by a pair of spaced members (as shown in FIG. 1 and as more fully described in the aforementioned co-pending application); the yoke 14 also includes a second arcuate frame 26. The two arcuate frames 24 and 26 are pivotally connected to a driving head 28 in a manner later to be described. A plurality of rods 30 extend through the frames 24 and 26 and have mounted thereon wheels 32 which ride against the surface of the pipe 10. Although only one wheel 32 is shown in FIG. 2 in connection with each rod 30, it should be understood that a similar wheel 32 is mounted on the end of the rod opposite from that shown in FIG. 2. Another rod 34 passes through the frame 26 and the driving head 28 to provide the pivotal connection referred to above between the arcuate frame 26 and the driving head 28. Simiarly, a rod 36 passes through the arcuate frame 24 and the driving head 28 to provide the pivotal connection referred to above between the arcuate frame 24 and the driving head 28. A locking means (not shown) is provided to hold the combined assembly (frames 24 and 26 and driving head 28) in the position shown in FIG. 2 so that the yoke 14 engages the surface of the pipe for slightly more than 180°. this locking means, for example, can be similar to the locking means shown in my aforementioned co-pending application. A pair of pulleys 38 (only one of which is shown in FIG. 2) are mounted at the opposite ends of the rod 34. Another pair of pulleys 40 (only one of which is shown in FIG. 2) are mounted at the opposite ends of the rod 36. A pair of belts 42 (only one of which is shown in FIG. 2) are disposed around the pulleys 38 and 40 and also over idler pulleys 44 (only one of which is shown). Each idler pulley 44 is designed to take up the slack in the belt 42 and, for this purpose, may be adjustable as to position. The driving head 28 has mounted thereon a motor 46 for driving a gear box 48 which, in turn, powers a chain 50 which drives the pulleys 38.

Figure 3:
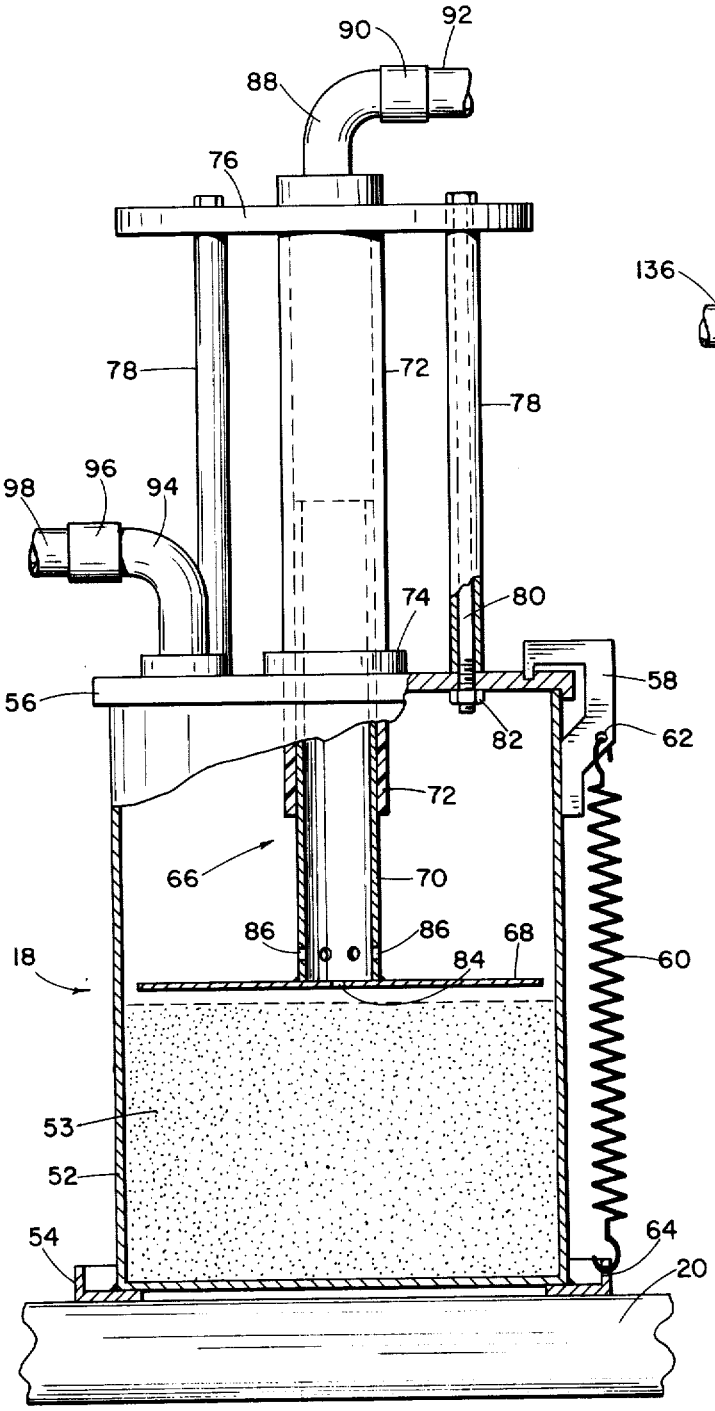
FIG. 3 is a side elevation, with certain parts in section, of the powder suspension device employed in the present invention.

Turning now to a consideration of FIG. 3, the powder suspension device 18 comprises a substantially cylindrical receptacle 52 which contains a quantity of powder 53 therein. A base 54 for the cylindrical container 52 is attached to the vehicle 20. A circular cover 56 is mounted at the top of the container 52. Hooks 58 (four in number) fit into suitable holes in the top of the cover 56. A spring 60 is associated with each hook 58, the upper end of each spring being received in a hole 62 in the hook and the lower end of each spring being received in a hole 64 in the base 54.

The powder suspension device 18 also includes a plunger assembly 66 which comprises a discoidal plate 68 attached to the lower end of a tube 70. The tube 70, which will be referred to hereinafter as the inner tube, is telescopically received within an outer tube 72. The outer tube 72, which may be of plastic material, passes through a collar 74 mounted on the cover 56 and extends upwardly to and beyond an upper plate 76. Spacers 78 (three in number) extend between the upper plate 76 and the cover 56, and bolts 80 pass through the upper plate 76, the spacers 78, and the cover 56. Nuts 82 are secured to the lower ends of the bolts 80 to hold the upper plate 76 in spaced relation to the cover 56 as shown in FIG. 2.

The discoidal plate 68 is provided with a central hole 84; the tube 70 is provided with a plurality of circumferentially spaced holes 86. The upper end of the outer tube 72 connects with an elbow 88 which, in turn, connects with a hose connector 90. A hose 92, which will be described hereinafter, connects with the hose connector 90.

Another elbow 90 is attached to the cover 56 and is in communication with the interior of the container 52 through a suitable opening (not shown) in the cover 56. A hose connector 96 is attached to the elbow 94 and connects with a hose 98 which will be described more fully hereinafter.

The powder dispension device 18 described above is similar to, and operates in similar fashion to, the device described in my prior U.S. Pat. No. 3,854,634 issued on Dec. 17, 1974, and entitled "Powder Dispenser".

Referring back to FIGS. 1 and 2, the combined blower and suction unit 22, which has been described as being similar to a vacuum cleaner type blower, includes a generally cylindrical tank or container 100 which has included therein an electric motor (not shown) which provides a stream of air under pressure from the outlet pipe 102 connecting with the hose 92 through a hose connector 104. An inlet pipe 106 at the bottom of the container 100 constitutes the suction inlet for the unit 22. Electrical power leads 108 connect with a suitable source of power (not shown) and also, in the interior of the tank 100, with the electrical motor (not shown). The upper end of the container 100 is also provided with an auxiliary outlet pipe 110 which connects with a valve 112. A handle 114 on the valve 112 permits the valve to be opened or closed, or partly opened, as desired. The valve 112 connects with a "u"-shaped pipe which, in turn, connects with a hose connector 118. A porous filter bag 120 connects with the hose connector 118.

Figure 5:
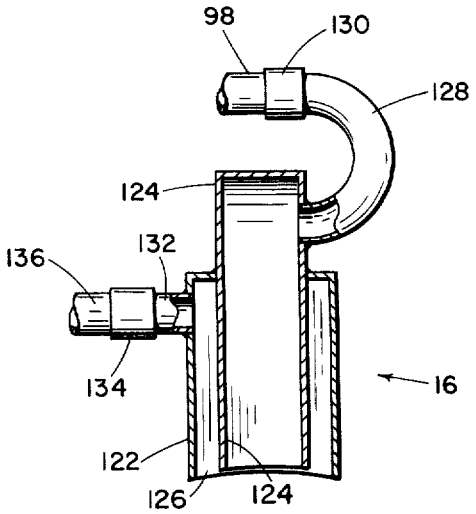
FIG. 5 is a view taken at right angles to FIG. 4, with certain parts in section.
Figure 4:
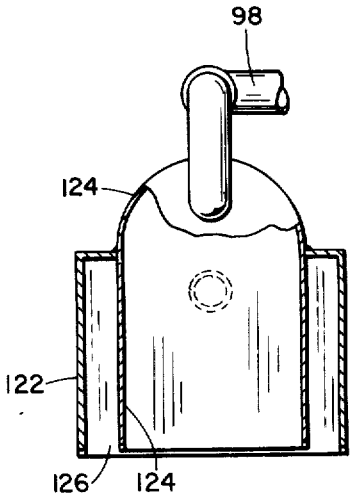
FIG. 4 is a side elevation of the powder dispensing device, with certain parts in cross section.

Turning now to FIGS. 4 and 5, the powder dispenser 16 includes an outer housing 122 open at the bottom and an inner housing 124, also open at the bottom, and forming a peripheral space 126 with the outer housing 122. The upper end of the inner housing 124 which extends above the top of the outer housing 122 connects with a "C"-shaped inlet pipe 128 which, in turn, connects with a hose connector 130. The hose connector 130 connects with the hose 98 which, as described earlier, connects with the elbow 94 on the outlet from the powder suspension device 18. The outer housing 122 connects with an outlet pipe 132 which, in turn, connects with a hose connector 134. The hose connector 134 connects with a hose 136 which extends back to the inlet pipe 106 through a hose connector 138. The hose 136, therefore, constitutes the vacuum or suction return from the powder dispenser 16. As indicated in FIG. 5, the lower ends of the inner and outer housings are arcuately shaped to conform with the outer circumference of the pipe 10.

In order for the vehicle 20 to move along the pipe 10, this vehicle is provided with a plurality of wheels 140 which are angularly attached to the vehicle as best shown in FIG. 2. The vehicle is also provided with a carrying frame 142 for the porpose of supporting the yoke 14 thereon. The frame 142 is provided with suitable notches 144 which are adapted to receive the rods 34 and 36 when the yoke 14 is suitably disposed over the frame 142. When the coating operation is completed on the weld joint 12, in a manner to be described briefly hereinafter, the frame of the yoke 14 is lifted up and set upon the carrying frame 142 after which the vehicle 20 is moved down the pipe to the next weld joint in the direction shown by the arrow 146.

The conduits 98 and 136 illustrated in FIG. 1 (also FIG. 2) are shown as broken because they are actually considerably longer than indicated in these figures. These conduits 98 and 136, are sufficiently long to permit the yoke 14 to move at least one full revolution around the pipe 10.

OPERATION

It will be assumed that the weld joint 12 has been previously heated by a suitable heating apparatus (not shown) to a temperature which will cause the powder 53 to fuse or melt and, also, to cure. With the vehicle 20 being positioned adjacent the heated weld joint 12, the yoke 14 is removed from the frame 142 and is disposed over the weld joint 12. The frame members 24 and 26 are locked relative to the driving head 28 into the position shown in FIG. 2. Power is supplied to the motor (not shown) within the tank 100 and power is supplied to the motor 46 through a suitable electrical connection (not shown).

A stream of air passes from the tank 100 through the hose 92 in the direction shown by the arrow, down through the tube 72 through the inner tube 70 and through the holes 84 and 86. The air passing through the hole 84 entrains powder in the stream and lfits the powder in a suspension around the outside of the disc 68 and into the space above the disc. The air passing through the holes 86 creates further turbulence in the space above the disc 68 and also creates the proper air to powder ratio in the gas stream leaving the device 18 through the outlet 94. The powder suspension passes through the hose 98 and to the dispenser 16, more particularly, to the inner housing 124 thereof. In the meantime, the motor 46 will be driving the apparatus 14 around the circumference of the weld joint 14 through the belts 42. The powder 53 will thus be sprayed on the outside of the weld joint 12 from the bottom of the inner housing 124. Preferably, the supply of powder to the weld joint 12 should be slightly in excess of that required for the weld joint. Therefore, there will be a certain excess of powder that would otherwise tend to blow into the air and contaminate the air in the region of the weld joint 12. However, the suction created in the outer housing 122 or, more particularly, in the space 126 between the inner and outer housings, will pick up this excess powder and return it to the bottom of the container 100 through the hose 136. The bottoms of the outer and inner housings 122 and 124 are preferably arcuately shaped as shown in FIG. 5 to facilitate the deposition of powder and the suction return of the same to the system.

The sizes and locations of the holes 84 and 86 are such that the disc 68 rides on the top of the body powder 53. As the powder is consumed, the disc and tube 70 fall by gravity to follow the upper level of the powder.

In the event that it is desired to cut down on the quantity of air supplied to the suspension device 28 through the hose 92, the valve 112 can be opened through the handle 144 to permit air to pass through the U-shaped connection 116 into the porous filter bag 120. The porous filter bag 120 will prevent any powder from passing into the atmosphere. From time to time, the bag 120 can be emptied into the container 52, as desired.

Reference is made above to a stream of "air" passing from the tank 100 through the hose 92, etc. Actually, this air will contain a quantity of powder therein depending, of course, on the amount of powder returned to the tank 100 through the conduit 136.

By way of the present invention, excess powder supplied to the weld joint is returned by suction to the system. This arrangement not only prevents the contamination of the air in the area of the weld joint, but also prevents or reduces the loss of powder from the system, thereby realizing an economy in the savings of powder material.

Whereas the present invention has been described in particular relation to the drawings attached hereto, it should be understood that other and further modifications of the invention, apart from those shown or suggested herein, may be made within the spirit and scope of this invention.

What is claimed is:

1. A system for spraying a powder circumferentially around a pipe or the like comprising a yoke engagable with the pipe for more than 180° of the circumference of the pipe, means for driving the yoke circumferentially about the pipe, a powder dispenser mounted on the yoke, a powder suspension device, a combined blower-suction device having a suction inlet and an outlet supplying a stream of air under pressure, a first conduit connecting the outlet of said blower-suction device to the interior of said powder suspension device for creating an air-powder suspension therein, said powder dispenser having an inner housing, said inner housing having an opening positioned adjacent the surface of the pipe for supplying a quantity of air-powder suspension to the surface of the pipe, said powder dispensing device having an outer housing surrounding said inner housing and having an opening positioned adjacent said pipe and surrounding the opening of said inner housing, said inner and outer housing being spaced from each other to form a space there between, a second conduit connected at one end to the interior of said powder suspension device and connected at an opposite end to the inner housing of said powder dispenser to provide a stream of air-powder suspension under pressure to said powder dispensing device, and a third conduit connected at one end to the space between said inner and outer housings and at an opposite end to the suction inlet for said blower-suction device for returning excess powder from the pipe back into the system.

2. A system for spraying powder as set forth in claim 1 including a vehicle movable along the pipe and wherein said powder suspension device and said blower-suction device are mounted on said vehicle.

3. A system for spraying powder as set forth in claim 2 wherein said vehicle includes a frame for supporting said yoke when said yoke is disengaged from the pipe.

4. A system for spraying powder as set forth in claim 1 wherein said blower-suction device includes an auxiliary outlet, a porous filter bag connected to said auxiliary outlet and an adjustable valve disposed between said auxiliary outlet and said porous filter bag to vary the amount of air passing through said auxiliary outlet into said porous filter bag.

5. A system for spraying powder as set forth in claim 1 wherein the open ends of said inner and outer housings are arcuately shaped to conform with the curvature of the pipe.

* * * * *